US012004595B2

(12) United States Patent
Blanchard

(10) Patent No.: US 12,004,595 B2
(45) Date of Patent: Jun. 11, 2024

(54) HOUSE SLIPPER-SNEAKERS / TENNIS SHOE SLIDES

(71) Applicant: Boyce Lamarr Blanchard, Saint Louis, MO (US)

(72) Inventor: Boyce Lamarr Blanchard, Saint Louis, MO (US)

( * ) Notice: Subject to any disclaimer, the term of this patent is extended or adjusted under 35 U.S.C. 154(b) by 0 days.

(21) Appl. No.: 17/702,340

(22) Filed: Mar. 23, 2022

(65) Prior Publication Data

US 2022/0322782 A1 Oct. 13, 2022

Related U.S. Application Data

(60) Provisional application No. 63/169,586, filed on Apr. 1, 2021.

(51) Int. Cl.

| | |
|---|---|
| ***A43B 3/10*** | (2006.01) |
| ***A43B 3/00*** | (2022.01) |
| ***A43C 1/02*** | (2006.01) |
| ***A43C 11/22*** | (2006.01) |

(52) U.S. Cl.

CPC ..... *A43B 3/0036* (2013.01); *A43B 3/102* (2013.01); *A43C 1/02* (2013.01); *A43C 11/22* (2013.01)

(58) Field of Classification Search

CPC ..... A43B 3/102; A43B 11/00; A43B 19/00; A43C 1/02; A43C 7/06; A43C 11/22

See application file for complete search history.

(56) References Cited

U.S. PATENT DOCUMENTS

| | | | | |
|---|---|---|---|---|
| 5,416,987 | A * | 5/1995 | Bemis | A43B 11/00 36/50.1 |
| 6,810,603 | B1 * | 11/2004 | Cosentino | A43B 23/17 36/8.3 |
| 8,225,535 | B2 * | 7/2012 | Dillenbeck | A43B 7/144 36/105 |
| 9,756,903 | B1 * | 9/2017 | Koo | A43C 11/002 |
| 2005/0252036 | A1 * | 11/2005 | Laska | A43B 3/242 36/11.5 |
| 2008/0250669 | A1 * | 10/2008 | Hallivis | A43B 7/00 36/88 |
| 2010/0236100 | A1 * | 9/2010 | Ho | A43B 3/24 36/100 |
| 2017/0295884 | A1 * | 10/2017 | Hung | A43B 13/36 |
| 2021/0282495 | A1 * | 9/2021 | Davis | A43C 11/12 |

* cited by examiner

*Primary Examiner* — Ted Kavanaugh

(57) ABSTRACT

The Slipper Sneaker basically describes itself. This shoe is fashion inspired and simply out performs old fashion house shoes and other slip-on shoes. The shoe's benefits include a secure fit when climbing steps, a sturdy sole for neighborhood trips, a knitted cuff for an added comfortable fit, and an arch support for the enthused wearer, and sweat absorbent cotton for our toes. The Slipper Sneakers are the ultimate blend for lounging around the house in flannel pajamas or in sporty muscle tops and jersey bottoms.

1 Claim, 13 Drawing Sheets

INTERIOR ELASTIC LACE
Front View / Left Shoe

REAR VIEW
Interior Elastic Lace

FIG. 12
FIG. 605
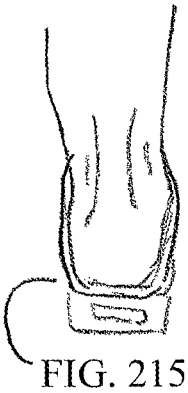
FIG. 610
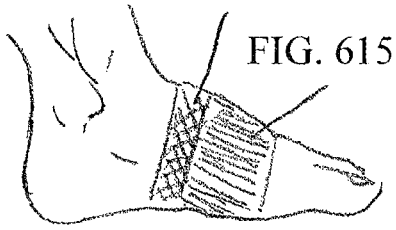
FIG. 11
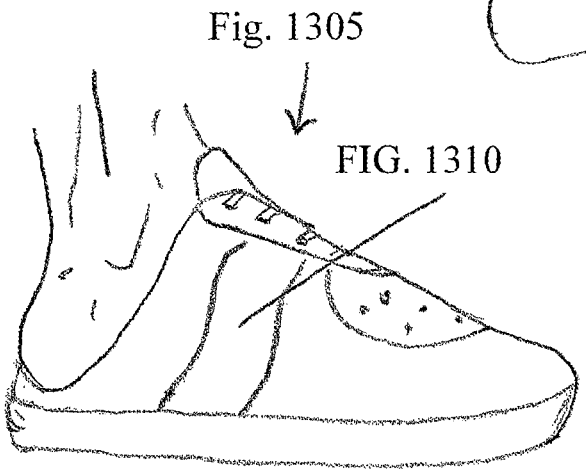
FIG. 13
Foot and Heel Illustrations Inner Elastic Rib and Anchor Illustrations

NO TIE ELASTIC LACE ILLUSTRATION

HOOP LACE / CROSS LACE POSITION

HOUSE SLIPPER-SNEAKERS / TENNIS SHOE SLIDES

CROSS-REFERENCE TO RELATED APPLICATIONS

The present application claims priority to the U.S. provisional patent application Ser. No. 63/169,586, filed on Apr. 1, 2021. The entire disclosure is included herein in its entirety, at least by reference.

BACKGROUND OF INVENTION

The present invention is within the field of the shoe apparel industry and pertains particularly to a novel embodiment of a shoe consisting of style, comfort, ease, and convenience for an array of indoor and outdoor family and friends' activities.

Slipper Sneakers are the new and improved quality footwear for lounging at home and strolling around your neighborhood in our ever growing innovative quick paced new society. Slipper Sneakers share the embodiments of many people's favorite shoes in mind. Slipper Sneakers are good for the user's feet and fit the styles of many people's favorite evening and daily lounging attire. The new slipper sneakers will be a considerable asset to the user in our fast paced society.

The new slipper sneaker is a creative solution and an alternative to the dullness, awkwardness, and hazards of the old fashion house shoe. Most house slipper creators many times neglect the idea of in-house protection surrounding the importance of maintaining good feet for the vanity of puff and fluff. The old fashion house shoe is not very safe indoors or outdoors. Old fashion slippers are vulnerable to the outdoors uneven sidewalks, sharp objects, and a variety of other materials discarded on the streets and occasionally in public parks. The slipper sneaker can be safely worn outside. The slipper sneaker will also offer more protection in the home against injury during our groggy late night and early morning trips around the house when the unforgiving bump of our toe on the furniture and doors on our mission to find our way in the dark house. The Slipper Sneaker will help remedy all the hazards noted above and more.

SUMMARY OF INVENTION

Slipper Sneakers have a unique style. The slipper sneaker involves duality which comprises both the design and utility apparatuses. The design concept relates to how the typical athletic shoe is newly fashioned into house shoe sneakers or tennis shoe slides. The utility concept relates to how the typical athletic shoe now performs in a less physical capacity than usual and is now utilized as house slipper sneakers or slip-on sneakers.

Unlike regular athletic shoes, the slipper sneakers are readily prepared to take on the hurried activities of everyday living because it is not equipped with a heel cover and therefore allows easy access for expeditious motions. Unlike our typical house shoes, the slipper sneakers are very supportive of the character involving our feet where the aspects that the typical house shoes neglect. In addition, the slipper sneaker also supports the character of our new attitudes involving our style of casual wear when the typical house shoes can't compete. People are more health conscious than ever and may prefer sports gear to lounge around the house. Our sporty jersey shorts and muscle shirts take the place of our flannel pajamas, which the slipper sneakers would also compliment if worn together.

In today's world many people find themselves spending their leisure time at home, and we'll make more than a few quick trips throughout our communities that don't require our full dress regalia and the slipper sneaker will certainly be very accommodating.

BRIEF DESCRIPTION OF THE DRAWINGS

The present invention is described in brief and enabling details in the following examples. The novel features of the invention are set forth in the appended claims. Such features may allow users, and or, caregivers to easily put on and take off the footwear.

For the purposes of explanation of the invention, several embodiments of the invention are given within the drawings. Throughout this specification the term "shoe" may be referred primarily to the "slipper sneaker." The term "porthole" may refer to where the user's foot would be inserted into the slipper sneaker. The term "lip" refers to the significantly reduced heel counter.

FIG. 7 illustrates ref 705, a makeshift inlay example of some interior featured components; ref. 710, the cotton lining at the vamp and nose of the shoe; ref 715, the insole; ref. 310, 610, 615, and 620 are the other components referred to.

FIG. 11 illustrates a hypothetical perspective of how 610 and 615 would fit around the foot without the shoe.

FIG. 12 illustrates a rear view perspective on how the heel may appear completely inside the shoe.

FIG. 13 illustrates ref. 1305, an active raised position of the shoe's elastic bands that may be influenced by the foot being placed firmly into the shoe; ref 1310 identifies a decorative overlay.

DETAILED DESCRIPTION OF THE INVENTION

The following description is of the best currently contemplated modes of carrying out the exemplary embodiments of the invention. The description is not to be taken in a limiting sense but is made merely for the purposes of illustrating the general principles of the invention. The scope of the invention is best defined in the appended claims.

Figure 1:
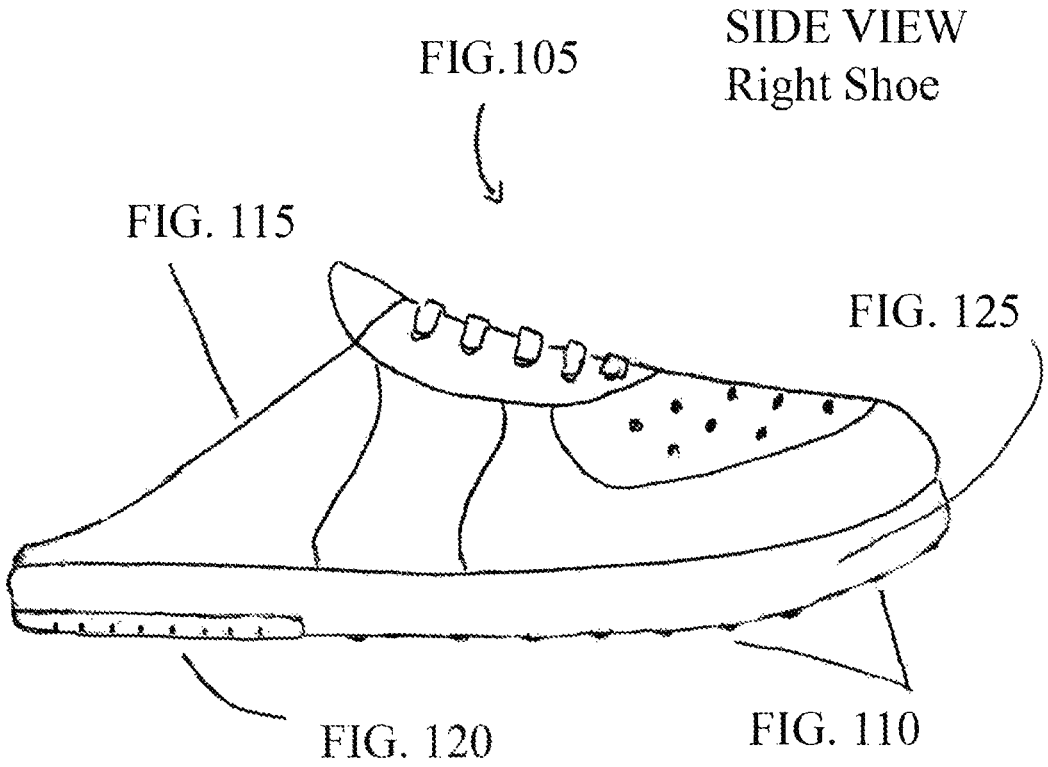
FIG. 1 illustrates ref. 105, a right shoe side view; ref. 110, the outsole; ref. 120, the outsole heel; ref. 125, the midsole; ref. 115, the top-line comprising approximately of a forty-five-degree angle from the lace cage to the narrow approximately one-fourth inch heel lip counter.

FIG. 1 shows 105 in a virtual idea of a leather shoe but may be constructed of other materials such as canvas or some kind of synthetic materials. We can logically gather from 105 the perspective that the flexible nature of 910, 520, and 820 are in a rested position in comparison to the apparatus's active position that is demonstrated when the shoe is being worn as shown in 1305. FIG. 1 also points to 115, the topline angle or slope which contributes to the easy access and style of the shoe. FIG. 1 also makes references to 110 and 120 which may be of a different color than 110 for added attraction; 125 may be susceptible to various groove designs.

Figure 2:
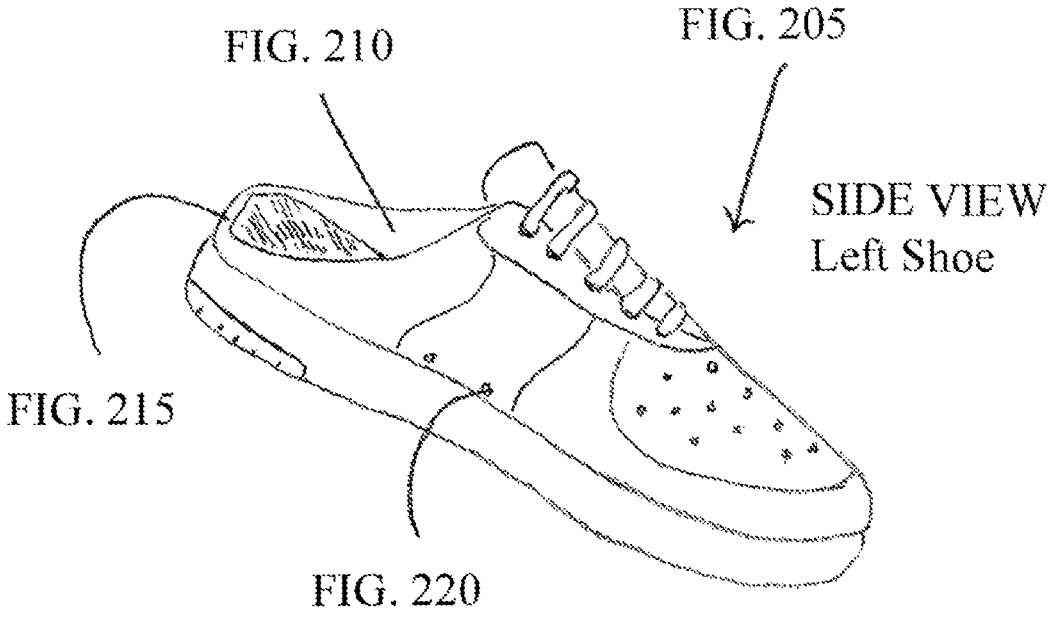
FIG. 2 illustrates ref. 205, a left shoe side view; ref 210, the lining of the shoe; ref. 215, the heel lip counter; ref. 220, two perforated holes that help allow the mid-foot to breathe.

FIG. 2 shows a perspective of 205 that allows 210 to be pointed out; 210 may be made of several comfortable materials capable of maintaining coolness and nay be absorbent of sweat especially in the area of our toes; 215 shows the lip of the heel counter that is reserved for style more so than stabilizing the heel of the foot; 220 is a combination of style and allows the midfoot air to breathe.

Figure 3:
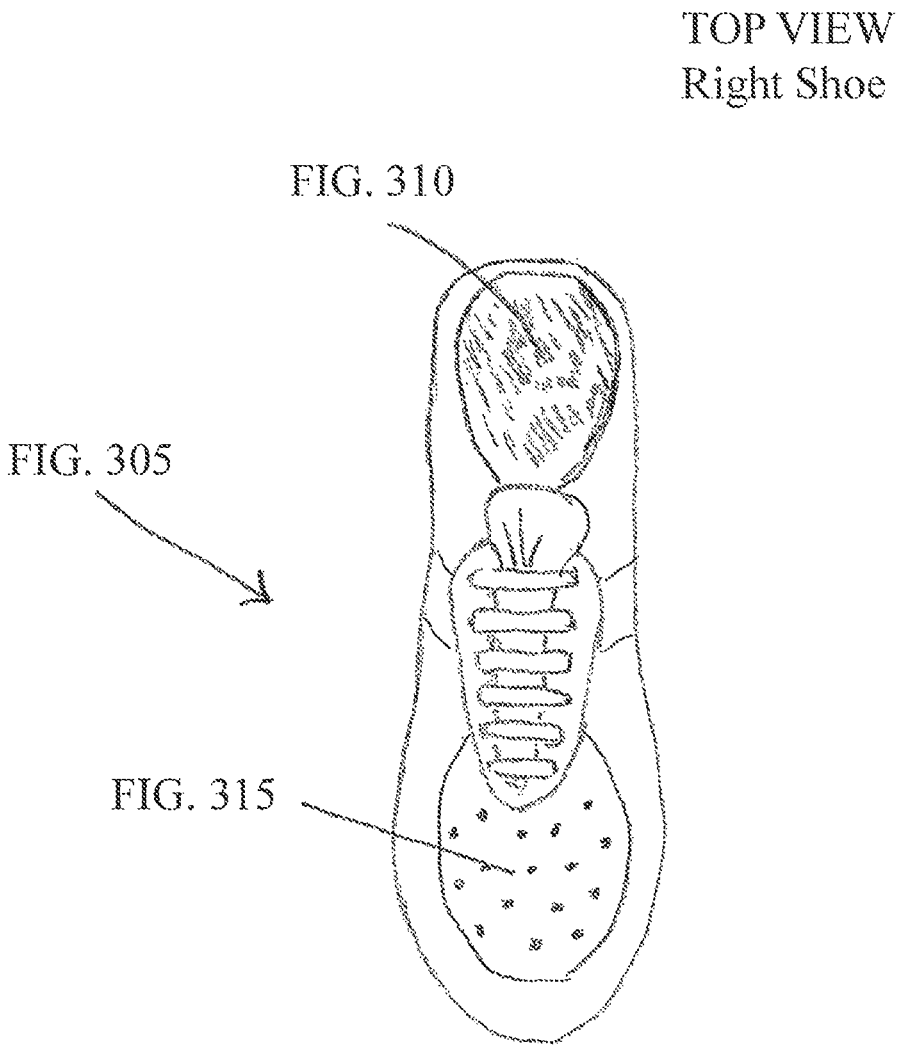
FIG. 3 illustrates ref. 305, a top view right shoe; ref 310 shows the cut-out heel counter, exposing a slight crater that represents an innovative heel cup; ref 315, the perforated toe box.

FIG. 3 shows an overhead view of the novel embodiment of the shoe's cut-out heel counter which re-establishes the design of a typical athletic shoe; 310 comprises of an ornamental insert about the heel's insole that may be constructed of plastic, rubber, or gel materials the set in support adjacent to 620; 310 may be considered a health conscious apparatus that offers a circular-centered slight depression or slight cup under the ball of the heel for an added measure of stability, comfort, and should be complementary to 620 and the overall orthotics to our natural foot alignment; 315 shows the perforated toe-box which allows the foot to breathe.

Figure 4:
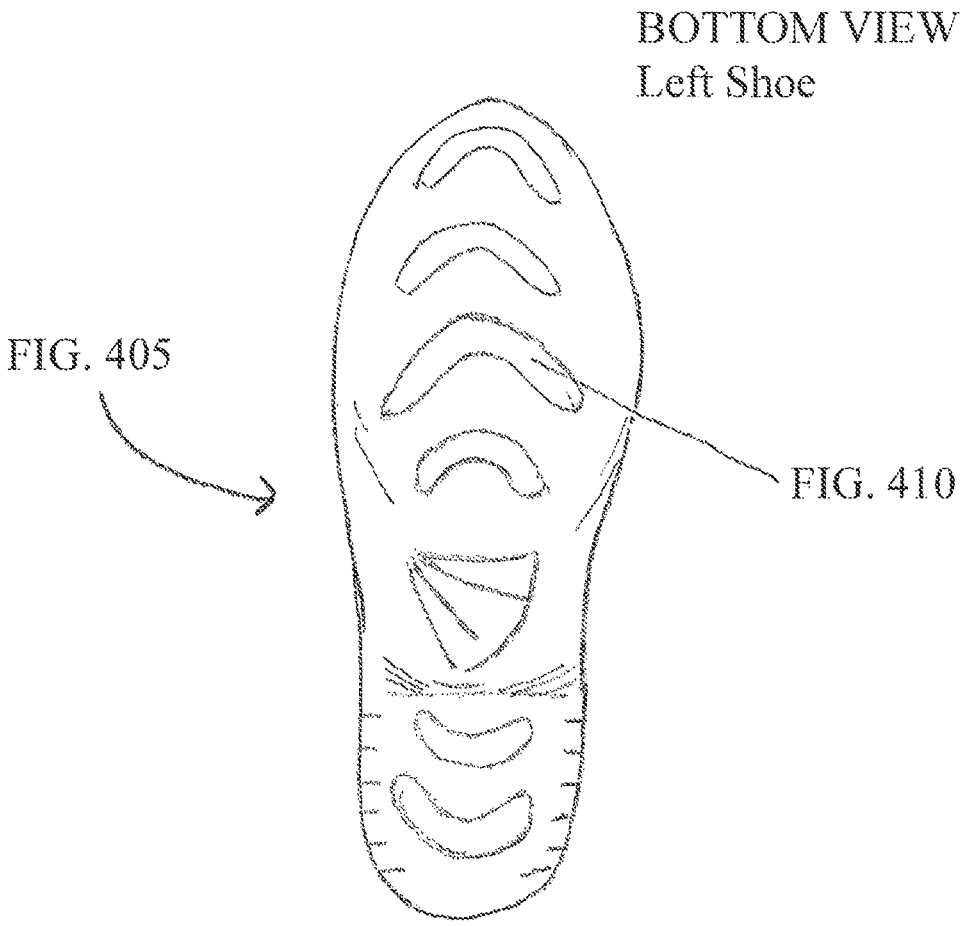
FIG. 4 illustrates ref. 405, a bottom view of the left shoe outsole; ref. 410, the smooth shallow curved treads.
Figure 5:
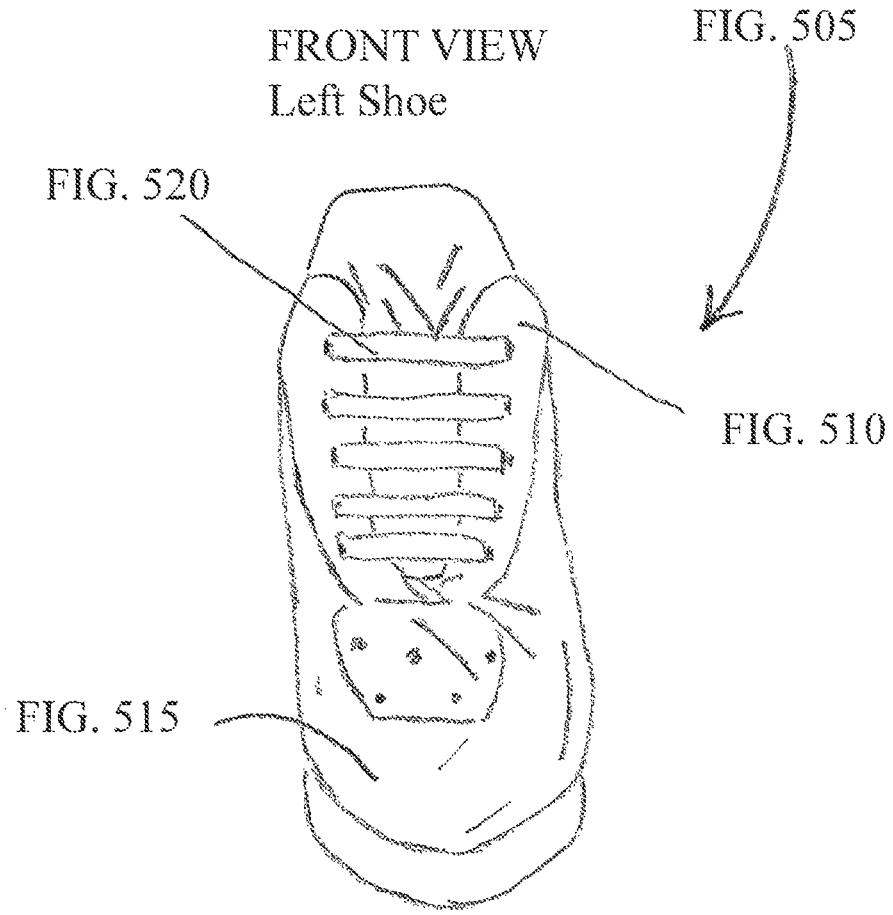
FIG. 5 illustrates ref. 505, a front view left shoe; ref. 510, the lace cage; ref. 515, the nose of the shoe or toe cap; ref. 520, a top-side of the hooped shaped elastic shoe laces.

FIG. 4 shows a bottom view perspective of 405; 405 may comprise of rubber or foam materials; 410 comprises of very shallow curved threads that are void of corners and grooves to help prevent collecting unwanted dirt and debris from outdoors back indoors; 410 style of threads may aid in either circumstance of maintaining the shoes on the feet in a forward motion and by adding a slight pressure to 120 in a reverse motion to remove the shoes. FIG. 5 show and identify 520, 515, and 510, in relation to 505.

Figure 6:
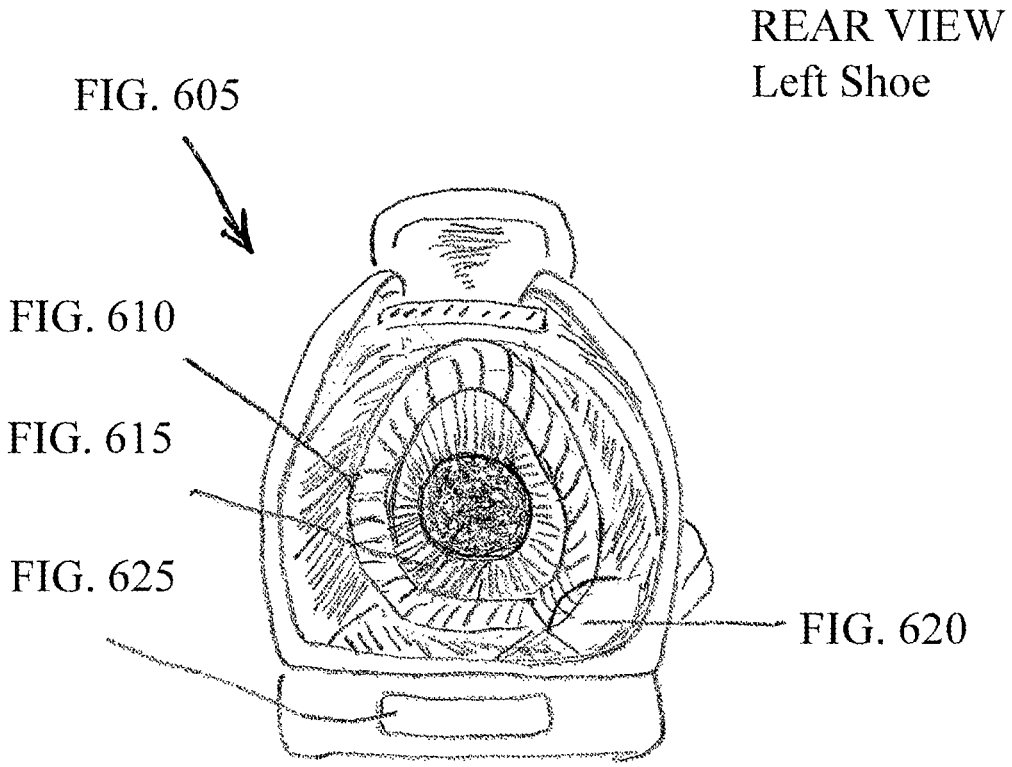
FIG. 6 illustrates ref 605, a rear view of the left shoe; ref. 610, the cylindrical elastic band; ref 615, the knit sleeve cuff; ref 620, the mold for the foot's arch support; ref 625, a label.

FIG. 6 shows the 605 perspective of an embodiment of novelty from a rear portal view; 610 is an apparatus that may be best fitted around the upper portion of our instep and between the heel and the arch of the foot; 610 may be constructed of a braided elastic band, or an elastic used in sock suspenders, or in garter belts; 610 shares in the responsibility with 615, 520, and 820 about holding the shoe in a safe position when the foot is in motion; 615 may be comprised of cotton knit similar to the wrist cuff on the end of a jacket or coat; altogether, 210, 510, 610, and 615 must be strategically attached with durable stitches; 620 may be constructed of rubber, plastic, or a gel, and built-in, or molded in the midsole for maintaining good feet, and posture.

Figure 7:
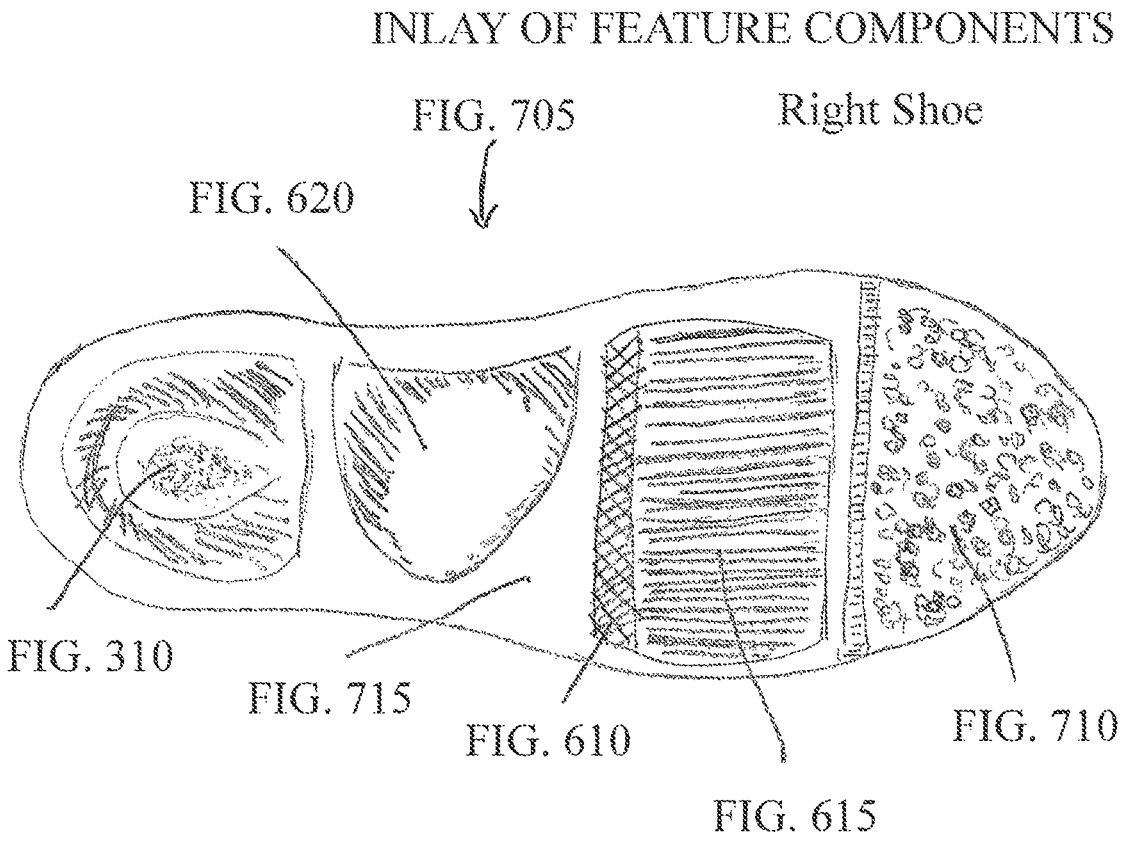

FIG. 7 shows a pictorial inlay of the different featured components associated with 715; 715 may be composed of natural materials or of the typical ethylene vinyl acetate (EVA) insole.

Figure 8:
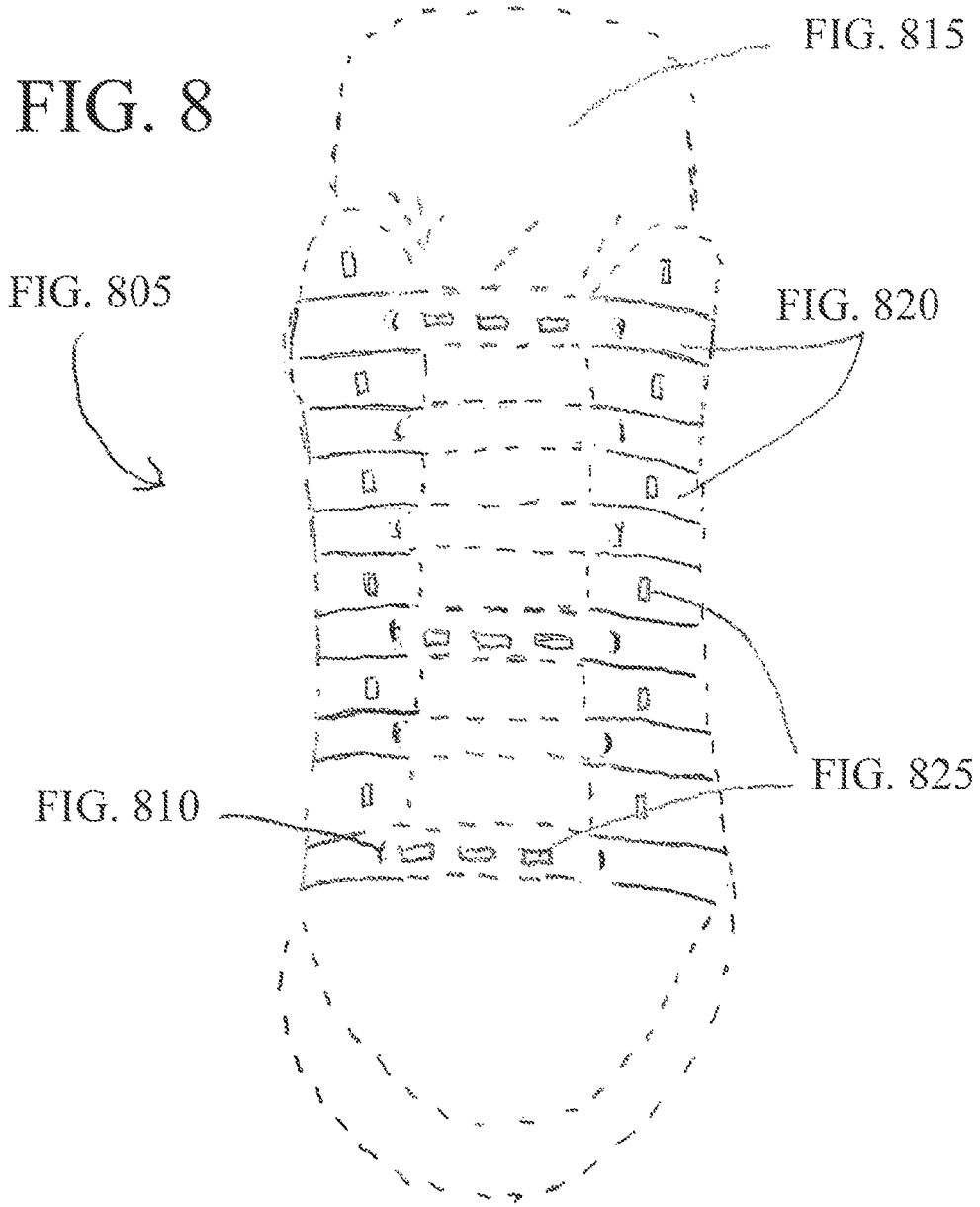
FIG. 8 illustrates ref. 805, a seen and unseen view of the elastic shoe laces and upper elastic laces attachments; ref. 810, the eyelets; ref. 815, the tongue; ref. 820, the inner elastic shoe laces; ref 825, the hidden elastic stud stitches that clamps 820 and 520 to 815.

FIG. 8 shows a novel 805 perspective of 815, 820, and 825 in comparison to the upper shoe; when in concern of the embodiment of 815, in a case when the shoe is being worn and the user feels the shoe is not snug enough, he or she may give a slight tug on 815 to force the porthole or throat of 605 to contract for a firmer fit; the spaced or separated lines about 805 are indications of 820; the darker spaced lines along the length of 510, and the spaced or separated rectangular squares, are indications of 825; 825 represents tiny elastic bands that should strategically secure the inelastic 815 to 520, and 820; 815 has a limited control in loosening or tightening the shoe's upper fit about the instep.

Figure 9:
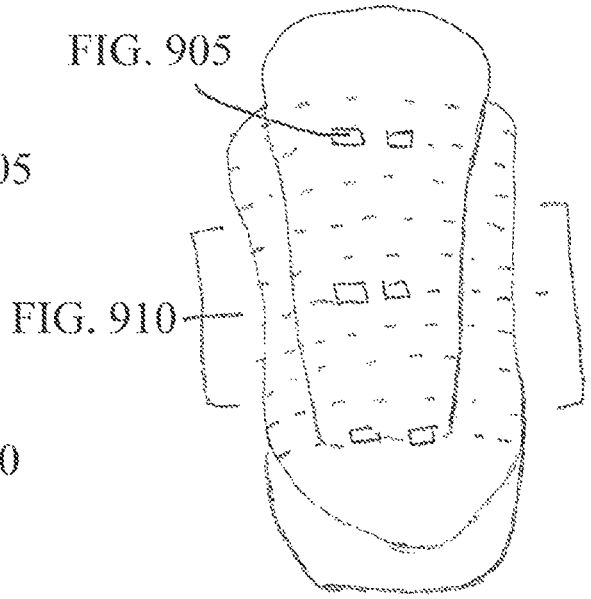
FIG. 9 illustrates ref. 905, a lower unseen elastic stud stitch view in comparison to 820; ref. 910 indicates the waist of the shoe.

FIG. 9 shows 905 perspective of several more tactical, tiny, rectangular elastic bands that connect the underside of 815 to the hooped underside of 520.

Figure 10:
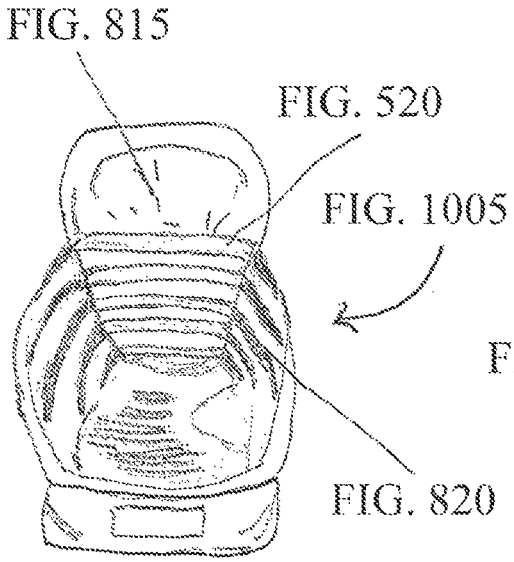
FIG. 10 illustrates ref 1005, a rear view perspective of the interior view of 520 and 820; 1005 shows the underbelly of 815 exposing the underside of 520 and the ribs of 820.

FIG. 10 shows a 1005 rear perspective and portal view of the relationship between 520, 815, and 820.

FIG. 11 shows how 610 and 615 may fit around the foot independently.

FIG. 12 shows the rear view perspective of how the wearer's heel may appear to fit in the shoe.

FIG. 13 shows a perspective of the wearer's foot properly lodged into the shoe and therefore elevating the upper part of the shoe and therefore activating the shoe from a rested position at 105, 520, and 820.

Figure 14:
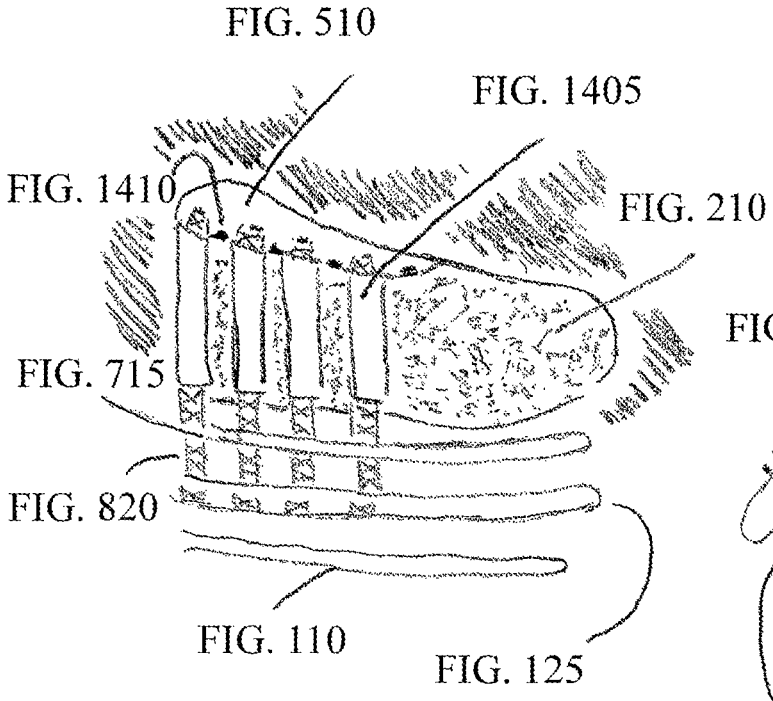
FIG. 14 illustrates an interior view of 820 in relation to the sleeve hem liners, and where 820 and 125 meet; ref. 1405, the open hemmed liner that sleeves 820 along the inner wall of 910; 1410 illustrates the reinforced stitches along the seam between 210, 510, and 910.

FIG. 14 shows a perspective of the interior components 210, 510, 715, and 125, in relation to 820 and 1405 and 1410; 820 passes by 715 and is held under 125 and along 210 and 910 by 1405 and 1410.

Figure 15:
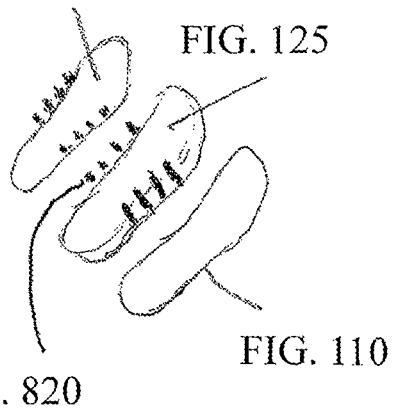
FIG. 15 illustrates an additional perspective about how 820 may be anchored and secured beneath 125.

FIG. 15 shows how 820 extends under 125, crosses under 125, and emerges on to the other side, and then continues back along the upper shoe; besides the weight of the shoe's wearer, 820 may be anchored and secured under 125 by a strong industrial glue; FIG. 15 in relation to 820 may certainly influence the Point of Measure (POM) when determining the lengths of 820 concerning sizing the shoes, small, medium, large, and extra-large.

Figure 16:
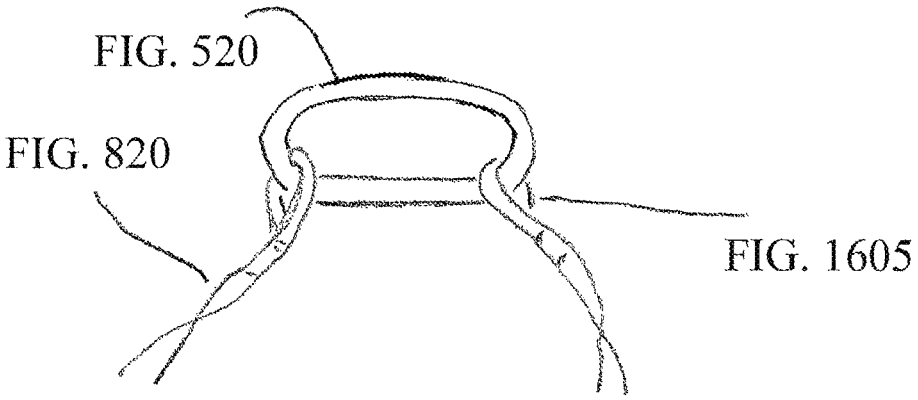
FIG. 16 illustrates ref. 1605, the looped stitch, and a perspective on how 1605 connects 520 to 820.

FIG. 16 shows the 1605 looped stitches connecting 520 and 820.

Figure 17:
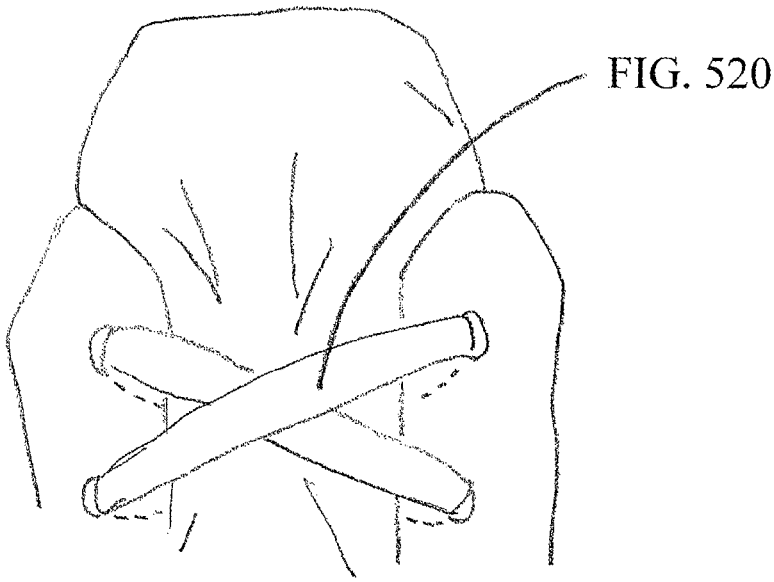
FIG. 17 illustrates the hooped laces in a cross-over position.

FIG. 17 illustrates the hooped laces in a cross over position along with a few dotted lines presented for the imaginary track of the lace running beneath 815.

It will be apparent to one with skills in the art of the shoe making business, concerning the house slipper-sneaker, may be provided some or all of the mentioned features and components without departing from the spirit and scope of the present invention. It will also be apparent to the skilled artisan that the embodiments described above are specific examples of a single broader scope than any of the singular descriptions demonstrated. There may be many alterations made in the descriptions without departing from the spirit and scope of the present invention.

The invention claimed is:

1. A slipper sneaker, comprising:

a sole having a outsole and a midsole located above the outsole;

an upper, coupled to the sole, the upper includes a vamp, a lace cage, a front toe cap, an apparatus coupled to the midsole that includes a knit sleeve cuff and an elastic band to be fitted around an upper portion of the user's instep, wherein the upper has a top edge which slopes downward and rearward from the lace cage to a lower heel lip counter to permit a user's foot to easily slip into the shoe and allow the user's heel to be exposed when worn;

a tongue coupled to the front toe cap;

a plurality of hooped shape elastic shoe laces coupled to the upper and the midsole, wherein each hooped shape elastic shoe lace comprising an exterior elastic shoe lace with opposing ends to wrap on the upper portion of the user's instep and interior hidden elastic shoe lace with opposing ends to wrap around the sides and bottom portions of the user's instep, wherein the opposing ends of the exterior shoe lace and the opposing ends of the interior elastic shoe lace are coupled to each other and to the tongue by stud stitches to form a hoop entirely around the user's foot for tightening the shoe around the instep of the foot.

* * * * *